US009587887B2

(12) United States Patent
Pustelnik et al.

(10) Patent No.: US 9,587,887 B2
(45) Date of Patent: Mar. 7, 2017

(54) PLATE COOLER FOR FLUIDS

(75) Inventors: Philipp Pustelnik, Vienna (AT); Thomas Euler-Rolle, Vienna (AT)

(73) Assignee: Alpver Vermoegens—Und Liegenschaftsverwaltungs GmbH, Vienna (AT)

( * ) Notice: Subject to any disclaimer, the term of this patent is extended or adjusted under 35 U.S.C. 154(b) by 495 days.

(21) Appl. No.: 12/996,230

(22) PCT Filed: May 15, 2009

(86) PCT No.: PCT/AT2009/000201
§ 371 (c)(1),
(2), (4) Date: Mar. 3, 2011

(87) PCT Pub. No.: WO2009/146474
PCT Pub. Date: Dec. 10, 2009

(65) Prior Publication Data

US 2011/0139418 A1 Jun. 16, 2011

(30) Foreign Application Priority Data

Jun. 3, 2008 (AT) ..... A 891/2008

(51) Int. Cl.
*F28F 3/12* (2006.01)
*F28D 1/053* (2006.01)
(Continued)

(52) U.S. Cl.
CPC ..... *F28D 1/05366* (2013.01); *F28F 9/002* (2013.01); *F28F 9/02* (2013.01);
(Continued)

(58) Field of Classification Search
CPC F28D 1/05366; F28D 2021/0049; F28F 9/02; F28F 21/084; F28F 9/0246;
(Continued)

(56) References Cited

U.S. PATENT DOCUMENTS 3,497,936 A 3/1970 Donaldson
4,582,127 A * 4/1986 Moranne ..... F28F 9/0226 165/173
(Continued)

FOREIGN PATENT DOCUMENTS

AT 402 235 3/1997
AT 414 042 8/2006
(Continued)

OTHER PUBLICATIONS

EPO Machine Translation of DE 3720483 A1, Miura et al. Jan. 28, 1988, Heat Exchanger, all page.*

*Primary Examiner* — Allana Lewin Bidder
*Assistant Examiner* — Kun Kai Ma
(74) *Attorney, Agent, or Firm* — Cozen O'Connor

(57) ABSTRACT

A plate cooler for fluids, such as hydraulic oil, having a parallelepiped-shaped package of plate bodies forming spaced-apart fluid channels and air channels interposed between adjacent plate bodies. The plate bodies communicate on their ends with a fluid channel in a distributor box and a collection box. The distributor and collection boxes have an extruded aluminum profile, a continuous fluid channel, and a ribbed body having lateral ribs with continuous guide grooves for mounting elements and receiving slots for the extruded plate body profile. The fluid channels discharge into a collection chamber, communicating with the continuous fluid channel of the ribbed body. The continuous receiving slots for the plate bodies in the distributor box and in the collection box are configured in circular and conical form, and the inserted plate bodies are connected thereto in fluid-tight fashion in a low-temperature adhesive bonding process.

13 Claims, 4 Drawing Sheets

(51) Int. Cl.

| | |
|---|---|
| ***F28F 9/00*** | (2006.01) |
| ***F28F 9/02*** | (2006.01) |
| ***F28F 21/08*** | (2006.01) |
| *F28D 21/00* | (2006.01) |
| *F28F 27/02* | (2006.01) |

(52) U.S. Cl.
CPC ..... *F28F 9/0246* (2013.01); *F28F 21/084* (2013.01); *F28D 2021/0049* (2013.01); *F28F 27/02* (2013.01); *F28F 2009/0292* (2013.01); *F28F 2250/06* (2013.01); *F28F 2255/16* (2013.01)

(58) Field of Classification Search
CPC ..... F28F 9/002; F28F 2255/16; F28F 2009/0292; F28F 2250/06
USPC ..... 165/67, 76, 166, 173, 178, 201
See application file for complete search history.

(56) References Cited

U.S. PATENT DOCUMENTS 5,046,555 A * 9/1991 Nguyen ..... 165/173
5,127,466 A * 7/1992 Ando ..... 165/67
5,307,870 A * 5/1994 Kamiya ..... F28F 1/022 165/153
5,417,277 A * 5/1995 Le Gauyer ..... F28F 9/0212 165/153
5,664,625 A * 9/1997 Letrange ..... F28F 9/02 165/149
5,896,923 A * 4/1999 Baba ..... F28D 1/05366 165/153
6,129,146 A * 10/2000 Krueger ..... F28F 9/02 165/173
6,167,956 B1 * 1/2001 Bostedo et al. ..... 165/284
6,176,303 B1 * 1/2001 Kobayashi ..... B21C 37/22 165/153
6,289,983 B1 * 9/2001 Pustelnik ..... 165/178
6,357,521 B1 * 3/2002 Sugimoto et al. ..... 165/173
6,575,227 B1 * 6/2003 Leeson et al. ..... 165/44
6,651,333 B2 * 11/2003 Letrange ..... F28F 9/02 29/890.052
6,932,152 B2 * 8/2005 Iwasaki ..... F28F 9/182 165/173
7,007,745 B2 * 3/2006 Iwasaki et al. ..... 165/81
7,044,208 B2 * 5/2006 Kawakubo et al. ..... 165/173
7,201,218 B2 * 4/2007 Hiyama ..... F28F 9/0224 165/173
2003/0085030 A1 * 5/2003 Gowan et al. ..... 165/173
2005/0051315 A1 * 3/2005 Ozaki ..... F28F 9/182 165/173
2005/0061494 A1 3/2005 Tsuji et al.
2006/0081363 A1 * 4/2006 Chissus ..... F28D 1/0435 165/173
2007/0000657 A1 * 1/2007 Emrich ..... B21D 39/06 165/173

FOREIGN PATENT DOCUMENTS

| | | |
|---|---|---|
| DE | 26 24 879 | 1/1977 |
| DE | 37 20 483 | 1/1988 |
| DE | 3720483 A1 * | 1/1988 |
| GB | 1 551 106 | 8/1979 |
| GB | 2 049 149 | 12/1980 |
| GB | 2 090 652 | 7/1982 |
| WO | WO 2005/045342 | 5/2005 |
| WO | WO 2006/083447 | 8/2006 |

* cited by examiner

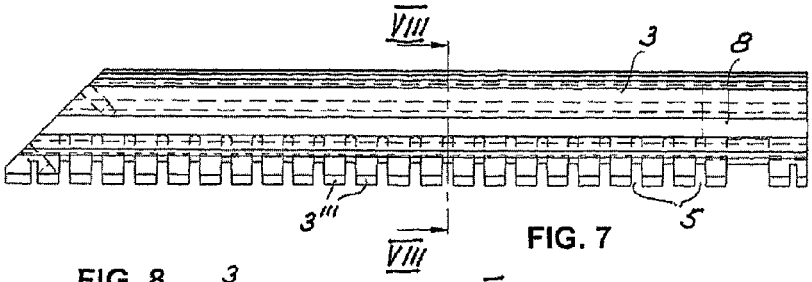
FIG. 7
FIG. 8
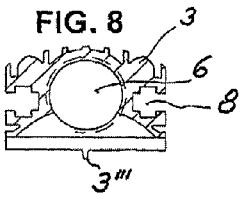
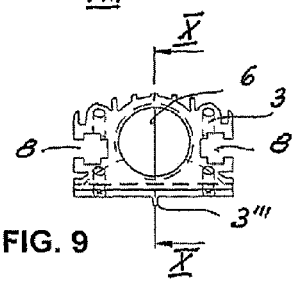
FIG. 9
FIG. 10
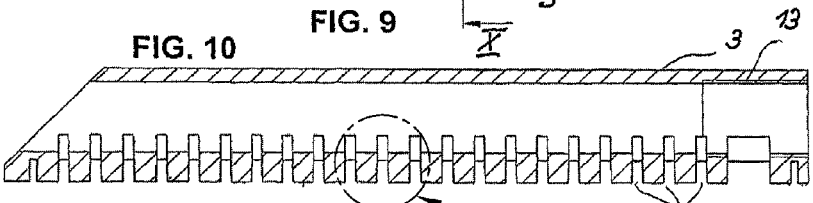
FIG. 11
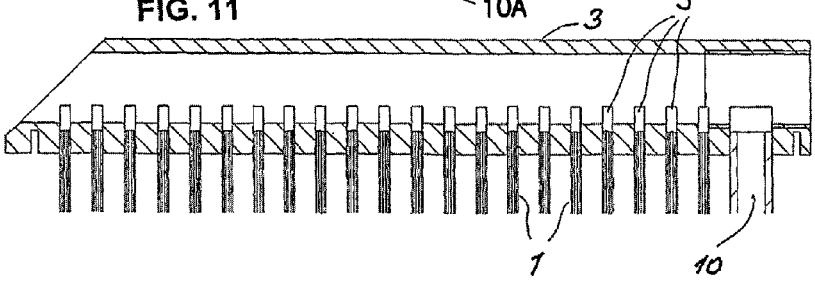
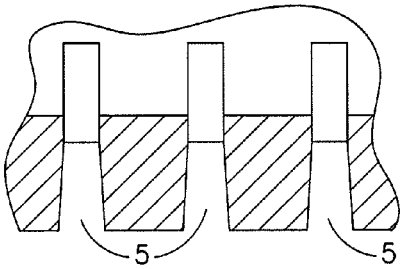
FIG.10A

PLATE COOLER FOR FLUIDS

RELATED APPLICATION

This is a U.S. national stage under 35 USC §371 of application No. PCT/AT2009/000201, filed on May 15, 2009.

This application claims the priority of Austrian Patent application no. A 891/2008, filed Jun. 3, 2008, the entire content of which is hereby incorporated by reference.

FIELD OF THE INVENTION

The invention relates to a plate cooler for fluids, in particular hydraulic oil, having a parallelepiped-shaped package of plate bodies forming spaced-apart fluid channels, in which air channels are interposed between adjacent plate bodies and the plate bodies communicate on their ends with fluid channels in a distributor box and a collection box, which are provided with inlet and outlet lines.

BACKGROUND OF THE INVENTION

In a plate cooler of the type defined above, it is already known to make a bypass flow in the cold state possible, by providing bypass channels, parallel to the fluid channels, in the package between the distributor box and the collection box, and in the vicinity of the bypass channels, the distributor box provided on the fluid inflow side is equipped in the vicinity of the bypass channels with a valve, which enables the communication between the distributor box and the bypass channels in the cold state.

In a hydraulic oil air cooler, it is also known for the hydraulic oil lines, leaving the distributor box and discharging into the collection box, to be formed by platelike extruded profiles of hollow cross section.

A further known embodiment comprises providing the extruded profiles with integrally formed-on inner ribs. In this way, the cooling surface area for the hydraulic oil is enlarged, and thus the cooling power is increased. For the same reasons, it is especially advantageous if the extruded profiles have a multiple-compartment cross section.

In the known construction, the platelike extruded profiles are soldered on the ends into openings in the distributor box and in the collection box, which while it is an economical manufacturing method still necessitates soldering in a vacuum or in an inert gas (CAB), which is relatively expensive.

SUMMARY OF THE INVENTION

One object of the invention is to provide a plate cooler which can be produced and assembled simply from only a few basic components, in order to further reduce the production costs and increase the number of possible uses of the cooler.

A cooler in accordance with an embodiment of the invention comprises a distributor box and a collection box that are each embodied as an extruded aluminum profile and are provided with a continuous channel, forming the fluid channel, and are also provided with a ribbed body, which has lateral ribs with continuous guide grooves for mounting elements and receiving slots for the extruded plate body profile, which discharge into a collection chamber, communicating with the continuous channel, of the ribbed body, which is in communication with the continuous channel.

Preferably, the receiving slots for the plate bodies in the distributor box and in the collection box are embodied in circular and conical form, and the inserted plate bodies are connected to them in fluid-tight fashion, preferably by a low-temperature method.

In another embodiment of the invention, the one end of the distributor box and of the collection box is chamfered, in order to receive adapter bodies for pipeline connections of different orientation.

BRIEF DESCRIPTION OF THE DRAWINGS

Further characteristics of the invention will be described in further detail below in terms of one exemplary embodiment, in conjunction with the drawings. In the drawings:

FIG. 7 is an elevation view of the distributor;

FIG. 8 is a section along the line VIII-VIII in FIG. 7;

FIG. 9 is an end view of FIG. 7;

FIG. 10 is a section along the line X-X in FIG. 9;

FIG. 10*a* is an enlarged view of section 10*a* in FIG. 10;

FIG. 11 is an analogous section to FIG. 10, but with oil pipes;

DETAILED DESCRIPTION OF THE DRAWINGS

Figure 1:
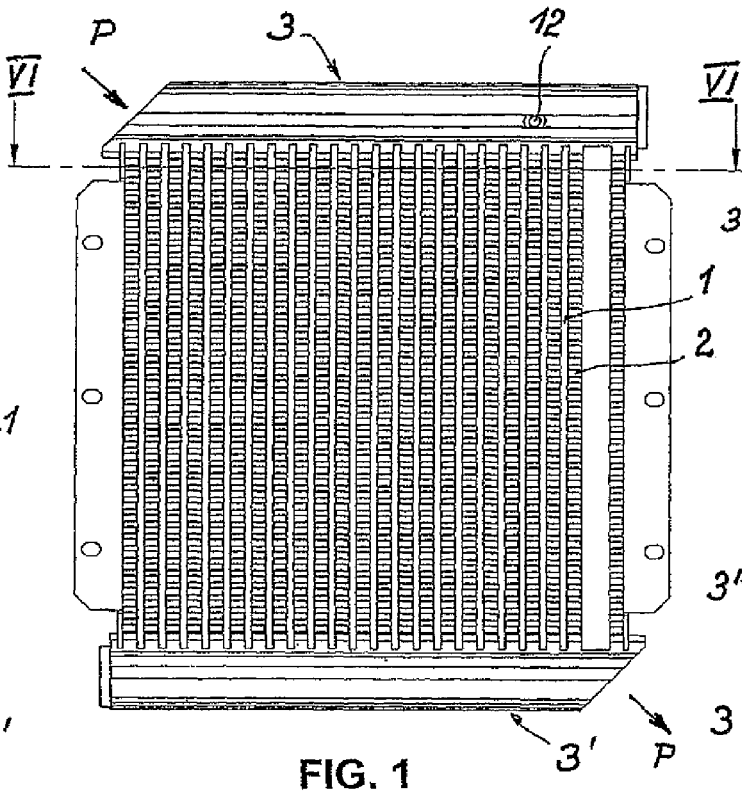
FIG. 1 is an elevation of view of the cooler of FIG. 1.
Figure 2:
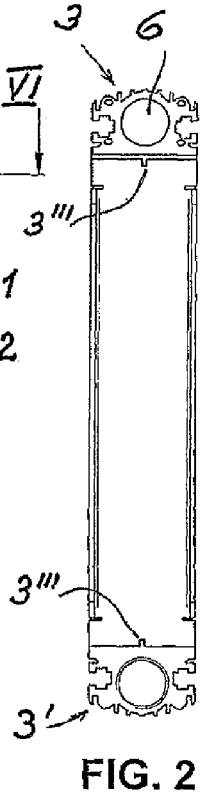
FIG. 2 is a left side view of the cooler of FIG. 1.
Figure 6:
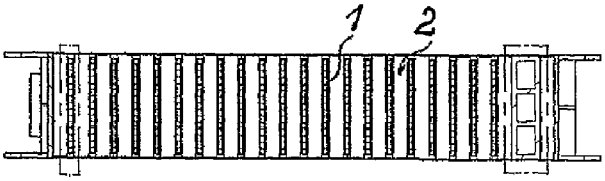
FIG. 6 is a section along the line VI-VI in FIG. 1.

The exemplary embodiment shown in FIG. 1 relates to a hydraulic oil cooler, which has a package of parallel plate bodies 1 and air channels 2 comprising air laminations 2' disposed between them, which in the example shown experience a flow through them from top to bottom and which terminate on their ends, beginning at a distributor box 3, in a collection box 3'. The distributor box 3 and the collection box 3' are embodied essentially identically. The plate bodies 1 are embodied as extruded aluminum profiles (for instance in accordance with Austrian Patent 402 235, the content of which is hereby incorporated by reference) and are retained in continuous slots 5 of the distributor box 3 and of the collection box 3', as FIG. 12 for instance shows.

The distributor box 3 and the collection box 3' each also comprise an extruded aluminum profile, which is equipped with an oil channel 6 and a ribbed body 7. The ribbed body, on opposing sides, has guide grooves 8 for receiving mounting elements, such as nuts 12 for bolts (not shown) for securing the cooler or the fan unit in a vehicle, machine, or the like.

Figure 3:
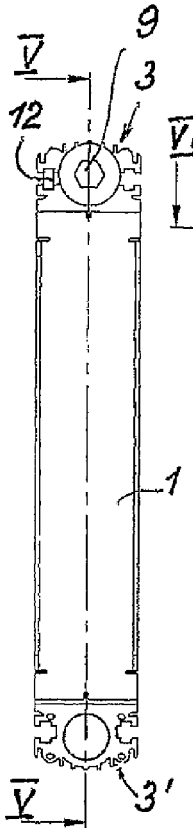
FIG. 3 is a right side view of the cooler of FIG. 1.
Figure 4:
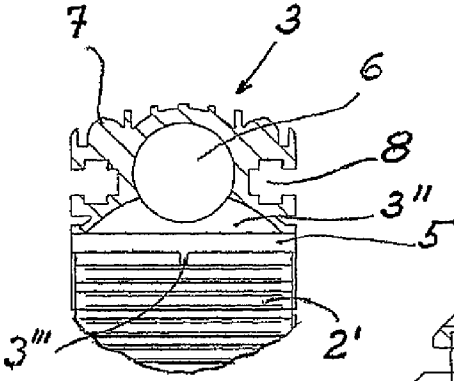
FIG. 4 shows a detail of FIG. 1 on a larger scale.
Figure 13:
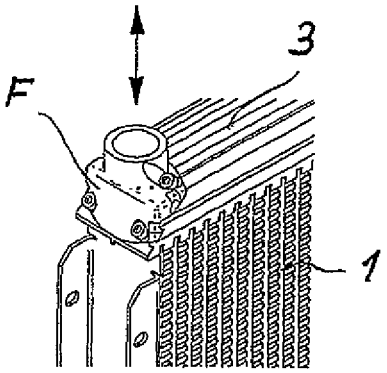
FIGS. 13-18 are fragmentary views of various adapter connections in perspective.
Figure 14:
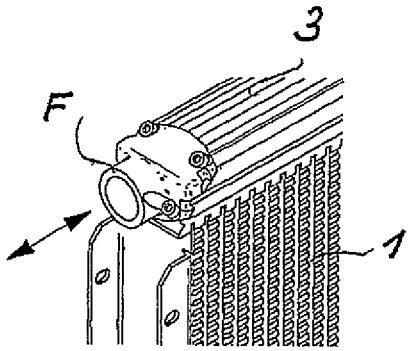
Figure 15:
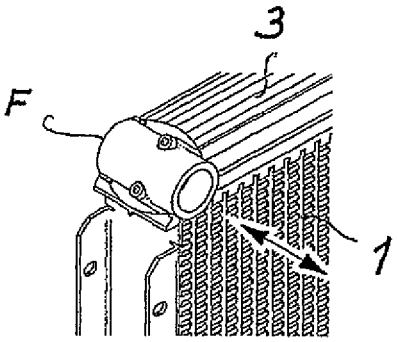
Figure 16:
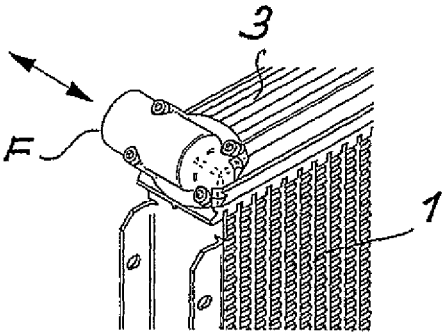
Figure 17:
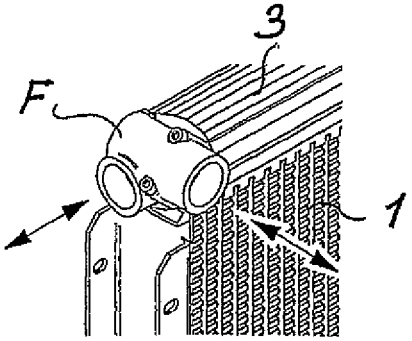
Figure 18:
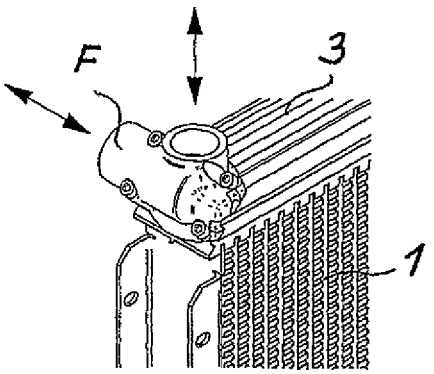

As seen for instance in FIG. 4, the plate bodies 1 each discharge into a vaulted oil collection box 3", communicating with the associated oil channel 6, of the distributor box 3 or collection box 3'. The thin plates 2' that form air channels each engage end ribs 3'" of the distributor box 3 and collection box 3'. One end each of the distributor box 3 and collection box 3' is chamfered at an angle of 45°, for example, so as to receive adapter bodies F, shown in FIGS. 13-18, for pipeline connections (not shown). The other end of each is closed with a closure screw 9, as FIG. 3 shows.

Figure 12:
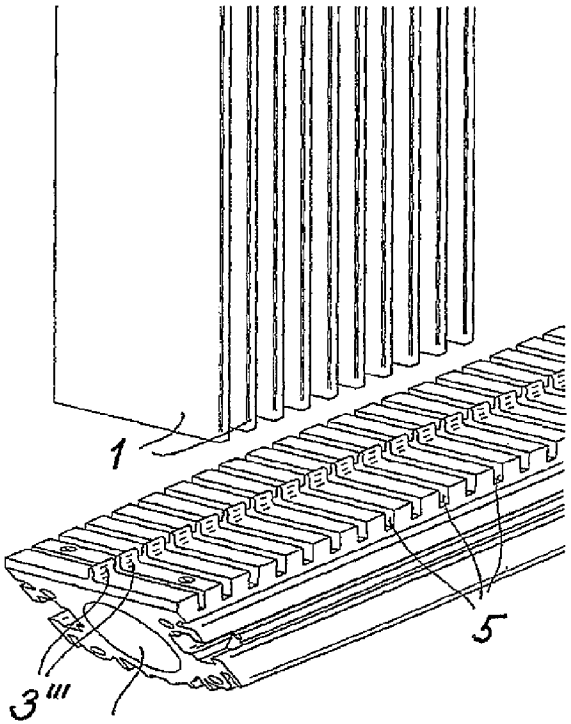
FIG. 12 is a perspective view of a part of the cooler before assembly.

The receiving slots 5 of the plate bodies 1 are, as FIGS. 10, 10*a*, and 12 in particular show, embodied in circular and conical fashion in the distributor box 3 and the collection box 3'. As shown in FIGS. 10*a*, 11 and 12, the receiving slots 5 extend over the widths of the collection box 3 and the distributor box 3' and are defined within the wall of the collection box 3 and distributor box 3' so that the ends of the plate bodies 1 do not pass the inner wall of the collection box 3 and distributor box 3' when the plate bodies 1 are inserted into the receiving slots 5. Also, shown in FIG. 10*a*, a distance between the flat opposing slot walls of the slots 5 continuously narrows from an entry portion to an interior portion of the slot 5, thereby forming acute angles between opposing slot walls, narrowing to a distance corresponding to the thickness of the respective plate bodies 1 such as to enable a fluid-tight surface mating between sides of the ends of the plate bodies 1 and the narrowing slot walls of the slots 5. The joining process for oil-tight connection can be a low-temperature (<300° C.) adhesive bonding process that does not necessitate an inert gas atmosphere or a vacuum. Within the scope of the invention, the plate bodies 1 inserted into the receiving slots 5 can also be soldered to the slots.

Figure 5:
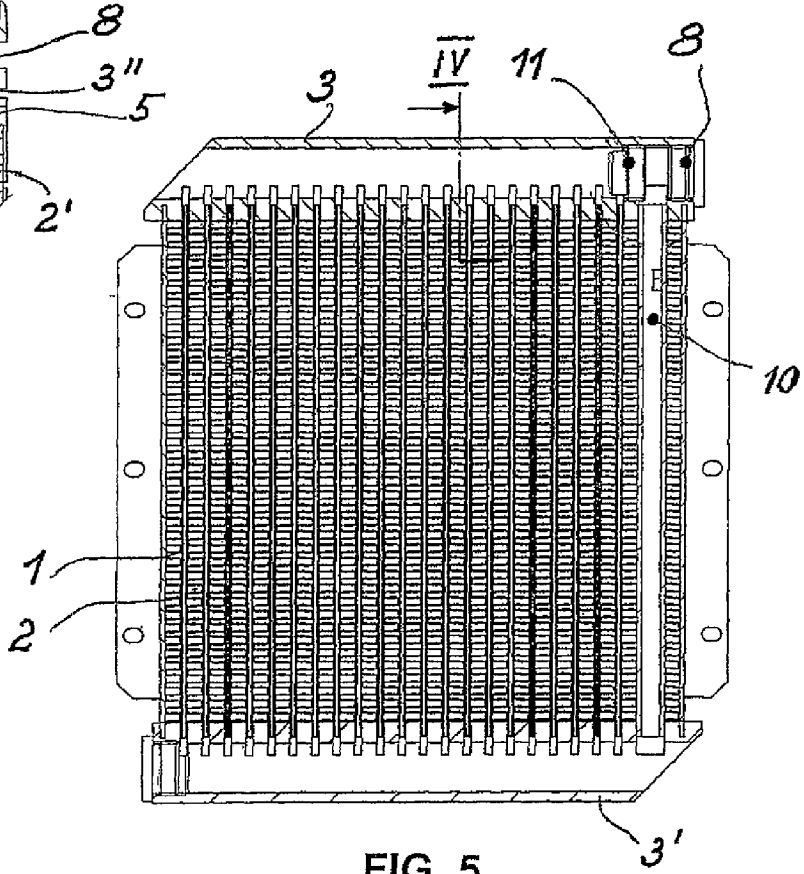
FIG. 5 is a section along the line V-V in FIG. 3.

In FIGS. 1 and 5, the oil cooler is equipped with bypass channels 10, known per se, and a valve 11 is screwed into the distributor box 3 via a female thread 13 on the end (for instance as in Austrian Patent 414 042). The valve closure body of the valve 11 can be prestressed into the closing position by a spring, preferably up to a pressure difference of 2-3 bar (opening pressure). This embodiment advantageously makes it possible in normal operation, when the oil is warm and the pressure loss via the plate bodies 1 is low (<2 bar), for the bypass to be closed and for all the oil to flow via the plate bodies 1. If in cold operation the pressure loss in the plate bodies 1 is >2-3 bar, the bypass valve 11 opens and enables the direction communication between the distributor box 3 and the collection box 3' via the bypass channels 10.

As FIGS. 13-18 show, the adapter body F for pipeline connections can be secured to the oblique face end of the distributor box 3 or collection box 3' with different orientation, without complicated welding, so that all the connection conditions that occur in practice can be properly taken into account. According to the invention, the cooler can experience a flow through it either in the form of a U or diagonally, as indicated for instance by the arrows P.

It is understood that the invention is not limited to the exemplary embodiments shown; on the contrary, they may be modified in various ways, for instance in terms of how the extruded plate bodies are embodied and how they are connected to the distributor box or the collection box.

The invention claimed is:

1. A plate cooler for fluids comprising:

a collection box at a first side of the plate cooler, the collection box defining a first fluid channel having an outlet;

a distributor box at a second side of the plate cooler opposite the first side, the distributor box defining a collection chamber and a second fluid channel having an inlet, wherein the first fluid channel and the second fluid channel form a continuous fluid channel; and a parallelepiped-shaped package of plate bodies, the plate bodies having first and second ends and a width, the plate bodies having constant thicknesses from their first ends to their second ends, the plate bodies forming spaced-apart fluid channels, the plate bodies communicating at their first and second ends with the first and second fluid channels in the distributor box and the collection box, respectively, wherein the widths of the plate bodies at the first and second ends is essentially the same as the widths of the collection box and the distributor box, respectively, wherein the plate bodies, the distributor box and the collection box are each embodied as an extruded aluminum profile, wherein the distributor box and the collection box are oriented transversely with respect to the plate bodies, wherein the distributor box and the collection box each have ribbed bodies, and each have receiving slots defined by straight opposing slot walls to respectively receive the first and second ends of the plate bodies, wherein the receiving slots:

a) extend over the widths of the collection box and the distributor box and are defined within the wall of the collection box and distributor box so that the ends of the plate bodies do not pass the inner wall of the collection box and distributor box when the plate bodies are inserted into the receiving slots, b) have curved peripheries adjacent the first and second fluid channels, and c) open into the second fluid channel via a collection chamber, and wherein a distance between the opposing straight slot walls of the slots continuously narrows along straight lines from an entry portion to an interior portion of the receiving slots, thereby forming acute angles between the opposing straight slot walls, narrowing to a distance corresponding to the thickness of the respective plate bodies such as to enable a fluid-tight surface mating between sides of the ends of the plate bodies and the narrowing slot walls.

2. The plate cooler of claim 1, wherein one end of the distributor box and of the collection box is chamfered, in order to receive adapter bodies for pipeline connections of different orientation.

3. The plate cooler of claim 1, wherein threads are formed on the ends of the first and second fluid channels of the collection box and of the distributor box, respectively, the threads being configured to secure functional elements.

4. The plate cooler of claim 1, wherein the ribbed body is provided with spacer ribs for thin plates that form air channels.

5. The plate cooler of claim 1, wherein the plates are connected to the receiving slots by adhesive bonding.

6. The plate cooler of claim 1, wherein the plates are connected to the receiving slots by soldering.

7. The plate cooler of claim 1, wherein the ribbed body has lateral ribs forming continuous guide grooves for mounting elements.

8. The plate cooler of claim 3, wherein the functional elements comprise valves for bypass channels and the threads are configured to secure the valves.

9. The plate cooler of claim 1, wherein the plate bodies are hollow.

10. The plate cooler of claim 1, wherein the plate bodies are parallel to each other.

11. The plate cooler of claim 1, wherein the receiving slots extend over the full width of the collection box and the distributor box.

12. The plate cooler of claim 1, wherein air channels are interposed between adjacent plate bodies.

13. A method of cooling hydraulic fluid by surrounding air using the plate cooler of claim 12.

* * * * *